United States Patent [19]

Kuwabara et al.

[11] Patent Number: 4,865,947

[45] Date of Patent: Sep. 12, 1989

[54] SILVER HALIDE PHOTOGRAPHIC MATERIAL

[75] Inventors: Kenichi Kuwabara; Yoshio Inagaki, both of Kanagawa, Japan

[73] Assignee: Fuji Photo Film Co., Ltd., Kanagawa, Japan

[21] Appl. No.: 237,624

[22] Filed: Aug. 26, 1988

Related U.S. Application Data

[63] Continuation of Ser. No. 799,690, Nov. 19, 1985, abandoned.

[30] Foreign Application Priority Data

Nov. 19, 1984 [JP] Japan ..... 59-244191

[51] Int. Cl.[4] ..... G03C 1/06

[52] U.S. Cl. ..... 430/264; 430/265; 430/427; 430/603; 430/610; 430/611; 430/613; 430/949

[58] Field of Search ..... 430/264, 265, 266, 267, 430/268, 423, 434, 949, 600, 603, 611, 613, 427

[56] References Cited

U.S. PATENT DOCUMENTS

| | | | |
|---|---|---|---|
| 4,166,742 | 9/1979 | Mifune et al. | 430/568 X |
| 4,168,977 | 9/1979 | Takada et al. | 430/448 X |
| 4,171,977 | 10/1979 | Hasegawa et al. | 430/282 X |
| 4,221,857 | 9/1980 | Okutsu et al. | 430/444 X |
| 4,224,401 | 9/1980 | Takada et al. | 430/440 |
| 4,243,739 | 1/1981 | Mifune et al. | 430/444 X |
| 4,272,606 | 1/1981 | Mifune et al. | 430/440 X |
| 4,311,781 | 1/1982 | Mifune et al. | 430/440 X |
| 4,323,643 | 4/1982 | Mifune et al. | 430/441 |

FOREIGN PATENT DOCUMENTS 1027146 4/1966 United Kingdom .

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A negative-type silver halide photographic material comprising a support and at least one light-sensitive silver halide emulsion layer on the support, wherein compounds represented by the general formulae (I) and (II) are incorporated in the light-sensitive silver halide emulsion layer or the hydrophilic colloid layer adjacent thereto. General Formula (I):

$$R_1—NHNH—G—R_2 \quad (I)$$

General Formula (II):

$$Z_0—S—Z_1 \quad (II)$$

wherein $R_1$ is an aliphatic or aromatic group, $R_2$ is a hydrogen atom, a substituted or unsubstituted alkyl group, a substituted or unsubstituted aryl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group, and $Z_0$ is an alkyl group, an aromatic group, or a heteroaromatic group, said group $Z_0$ being substituted with at least one group selected from the group consisting of a hydroxy group, a group $—SO_3M^1$, or a group $—COOM^1$ wherein $M^1$ is a hydrogen atom, an alkali metal atom, or a substituted or unsubstituted ammonium ion; a substituted or unsubstituted amino group, and a substituted or unsubstituted ammonium group, or with a substituent having at least one group selected from the above group, and $Z_1$ is a hydrogen atom, an alkali metal atom, a substituted or unsubstituted amidino group, a hydrohalogenic acid salt or a sulfonic acid salt thereof, or $—S—Z_0$.

This light-sensitive material provides an image of ultra-high contrast and high sensitivity on developing with a developer having good storage stability. Moreover, this silver image can be reduced with a reducing solution containing a cerium (IV) salt without forming a residue.

21 Claims, No Drawings

SILVER HALIDE PHOTOGRAPHIC MATERIAL

This is a continuation of application Ser. No. 06/799,690, filed Nov. 19, 1985, now abandoned.

FIELD OF THE INVENTION

The present invention relates to a silver halide photographic material which upon application of a processing solution having high stability, can rapidly produce images of super-high contrast useful in the field of photoengraving. More particularly, it is concerned with a silver halide photographic material which when exposed imagewise and then developed, produces silver images which was treated with a reducing solution.

BACKGROUND OF THE INVENTION

At the photo-engraving process in the field of print-duplicating, a photographic image having continuous gradation is converted into a dot image, in which the density of the image is represented in terms of the dot area, and a print manuscript is prepared by combining together the dot image and a manuscript containing figures and lines.

In order to improve reproduction of line and dot images, the light-sensitive material used in photoengraving process must have ultra-high contrast photographic characteristics (in particular, a $\gamma$ of 10 or more), i.e., sufficiently high image contrast to clearly distinguish an image area from a non-image area, and high blackening density. Thus it is required to develop an image-forming system satisfying such requirements.

For this purpose, a method has generally been employed in which a lith-type silver halide light-sensitive material containing silver chlorobromide with 40 mol% or less of silver bromide is processed with a hydroquinone developer (lith developer) in which the effective concentration of sulfite ions is very low (usually 0.1 mol/l or less). In this method, however, the developer is extremely unstable against air oxidation because the concentration of sulfite ions in the developer is low.

An image-forming system is desired that overcoming the instability in formation of images due to the lith developer and provides ultra-high contrast photographic characteristics using a processing solution having good storage stability. U.S. Pat. Nos. 4,166,742, 4,168,977, 4,221,857, 4,224,401, 4,243,739, 4,272,606, 4,311,781 disclose a system for forming negative images of ultra-high contrast (i.e., a $\gamma$ in excess of 10) by processing a surface latent image-type silver halide photographic material containing a specific acylhydrazine compound at a pH of 10.5 to 12.3 with a developer of good storage stability, containing 0.15 mol/l or more of a sulfite preservative. This image-forming system permits the use of silver iodobromide or silver chloroiodobromide of high sensitivity, while on the other hand, in the conventional method of formation of ultra-high contrast images, only silver chloride or silver chlorobromide can be used.

Further, Japanese Patent Application (OPI) No. 68419/77 (the term "OPI" as used herein means a "published unexamined Japanese Patent Application") also discloses the system for forming negative image though there is no discription about a light-sensitive material having an ultra-high contrast by using hydrazine derivatives.

It is necessary for the dot images, or line and figure images formed by the above image-forming system to have good printability (i.e., such property that a demanded quality of finale prints such as color density, color balance, and line width of line image is satisfied). For this printability, the silver image must often be corrected. For this correction of silver images, a reduction method is employed in which by contacting the silver image with a reducing solution, the blackened area of dots is reduced and the line and figure images are corrected.

The reduction is to dissolve a silver image through oxidation. Therefore, by reduction the density of the silver image is decreased. The "effective reduction width" is the extent to which the area of the silver image can be reduced in relation to the original area when the density of the silver image is lowered to the very limited necessary value for the photo-engraving (for example, a transmission optical density of 2.5).

In connection with reduction, many studies have been made, including those described in Japanese Patent Application (OPI) Nos. 140733/76, 68419/77, 119236/79, 119237/79, 2244/80, and 2245/80 (the term "OPI" as used herein means a "published unexamined Japanese patent application"). In these methods, a reducing solution containing red prussiate (i.e., potassium ferricyanide) as a major component has been used. This reducing solution, however, is subjected to environmental regulation due to its pollution of waste water and, therefore, cannot be used without expensive waste water treatment. For this reason, a reducing solution containing a cerium (IV) salt as a major component has been used in recent years.

If, however, a silver image formed by processing a surface latent image-type silver halide photographic material containing an acylhydrazine compound as described above with a developer containing 0.15 mol/l or more of a sulfite preservative and adjusted to pH 10.5 to 12.3 is treated with a reducing solution containing a cerium (IV) salt as a major component, a problem arises in that a yellow-brown residue is formed around the reduced silver image and the effective reduction width is reduced.

If the above residue has an optical density above a certain limit, it functions as a component constituting the image and, therefore, undesirably decreases the effective reduction width.

SUMMARY OF THE INVENTION

An object of the present invention is to provide a silver halide photographic material which is of high sensitivity and can produce images of ultra-high contrast, i.e., with a $\gamma$ in excess of about 10, upon application of a developer having good storage stability and, furthermore, which can produce silver images which can be reduced with a reducing solution containing a cerium (IV) salt without formation of a residue.

It has been found that this object can be attained by a silver halide photographic material containing both a compound represented by the general formula (I) as described hereinafter and a compound represented by the general formula (II) as described hereinafter.

Particularly, the present invention relates to a negative-type silver halide photographic material comprising a support having thereon at least one light-sensitive silver halide emulsion layer on the support, the silver halide emulsion layer or a hydrophilic colloid layer adjacent thereto containing (a) a compound represented by the general formula (I):

$$R_1—NHNH—G—R_2 \quad (I)$$

wherein $R_1$ is an aliphatic group or an aromatic group, $R_2$ is a hydrogen atom, a substituted or unsubstituted alkyl group, a substituted or unsubstituted aryl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group, and (b) a compound represented by the general formula (II):

$$Z_0—S—Z_1 \quad (II)$$

wherein $Z_0$ is an alkyl group, an aromatic group, or a heteroaromatic group, each group being substituted with at least one group selected from the group consisting of a hydroxy group, a group $—SO_3M^1$, a group $—COOM^1$ (wherein $M^1$ is a hydrogen atom, an alkali metal atom, or a substituted or unsubstituted ammonium ion), a substituted or unsubstituted amino group, and a substituted or unsubstituted ammonium group, or with a substituent having at least one group selected from the above group, and $Z_1$ is a hydrogen atom, an alkali metal atom, a substituted or unsubstituted amidino group (which may form a hydrohalogenic acid salt or a sulfonic acid salt), or $—S—Z_0$).

DETAILED DESCRIPTION OF THE INVENTION

In the present invention, a silver halide emulsion containing about 0.5 mol% or more of silver iodide is preferably used.

The hydrazine derivatives of the general formula (I) will hereinafter be explained in detail.

In the general formula (I), the aliphatic group represented by $R_1$ preferably has about 1 to 30 carbon atoms. Particularly preferred is a straight, branched, or cyclic alkyl group having about 1 to 20 carbon atoms. The branched alkyl group may be cyclized so as to form a saturated hetero ring containing therein one or more hetero atoms. The alkyl group may be substituted with, for example, an aryl group, an alkoxyl group, a sulfoxy group, a sulfonamide group, and a carbonamide group.

The aromatic group represented by $R_1$ is a monocyclic or dicyclic aryl group, or an unsaturated heterocyclic group. This unsaturated heterocyclic group may be condensed with a mono- or di-cyclic aryl group to form a heteroaryl group.

Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Particularly preferred are those containing a benzene ring.

A particularly preferred example of $R_1$ is an aryl group.

The aryl group or unsaturated heterocyclic group, represented by $R_1$ may be substituted. Typical substituents include a straight, branched or cyclic alkyl group (preferably having about 1 to 20 carbon atoms), an aralkyl group (preferably a mono- or di-cyclic group in which the number of carbon atoms of the alkyl portion is 1 to 3), an alkoxyl group (preferably having about 1 to 20 carbon atoms), a substituted amino group (preferably substituted with an alkyl group having about 1 to 20 carbon atoms), an acylamino group (preferably containing about 2 to 30 carbon atoms), a sulfonamido group (preferably having about 1 to 30 carbon atoms), and a ureido group (preferably having about 1 to 30 carbon atoms).

The alkyl group represented by $R_2$ is preferably an alkyl group having 1 to 4 carbon atoms and may be substituted with, for example, a halogen atom, a cyano group, a carboxyl group, a sulfo group, an alkoxyl group, and a phenyl group.

Of the groups represented by $R_2$, the aryl group which may be substituted is a mono- or di-cyclic aryl group. The aryl group is an aryl group containing a benzene ring. This aryl group may be substituted with, for example, a halogen atom, an alkyl group, a cyano group, a carboxyl group, or a sulfo group.

Of the groups represented by $R_2$, the alkoxy group which may be substituted is an alkoxyl group having 1 to 8 carbon atoms, which may be substituted with, for example, a halogen atom and an aryl group.

Of the groups represented by $R_2$, the aryloxy group which may be substituted is preferably monocyclic group. The substituent includes a halogen atom.

Preferred among the groups represented by $R_2$ are a hydrogen atom, a methyl group, a methoxy group, an ethoxy group, and a substituted or unsubstituted phenyl group when G is a carbonyl group. Particularly preferred is a hydrogen atom.

When G is a sulfonyl group, $R_2$ is preferably a methyl group, an ethyl group, a phenyl group, or a 4-methylphenyl group. Particularly preferred is a methyl group.

When G is a phosphoryl group, $R_2$ is preferably a methoxy group, an ethoxy group, a butoxy group, a phenoxy group, or a phenyl group. Particularly preferred is a phenoxy group.

When G is a sulfoxy group, $R_2$ is preferably a cyanobenzyl group, or a methylthiobenzyl group.

When G is an N-substituted or unsubstituted imino group, $R_2$ is preferably a methyl group, an ethyl group, or a substituted or unsubstituted phenyl group.

The groups represented by $R_1$ or $R_2$ may contain a ballast group commonly used in immobile photographic additives such as a coupler. The term "ballast group" as used herein refers to a group having 8 or more carbon atoms and relatively inert photographic properties (i.e., such properties that have little influence on photographic properties). Examples are an alkyl group, an alkoxyl group, a phenyl group, an alkylphenyl group, a phenoxy group, and an alkylphenoxy group.

The groups represented by $R_1$ or $R_2$ may contain a group enhancing adsorption on the surface of silver halide particles. Examples of such adsorption groups are a thiourea group, a heterocyclic thioamide group, a mercaptoheterocyclic group, and a triazole group, as described in U.S. Pat. No. 4,385,108.

As G of the general formula (I), a carbonyl group is most preferred.

The synthetic method of the compounds of the general formula (I) is described in U.S. Pat. Nos. 4,168,977, 4,224,401, 4,171,977, and 4,323,643, and in S. R. Sandler and W. Karo, *Organic Functional Group Preparations*, Second Edition, The Academic Press, Vol. I, pages 435–465 (1983).

Typical examples of the compounds of the general formula (I) are shown below, although the present invention is not to be construed as being limited thereto.

I-1
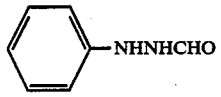
I-2
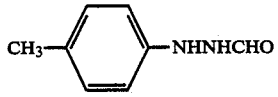
I-3
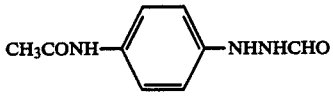
I-4
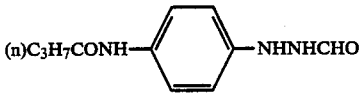
I-5
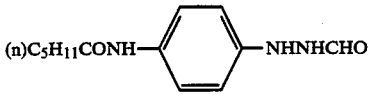
I-6
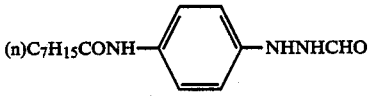
I-7
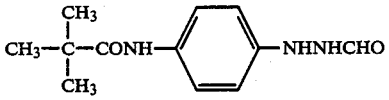
I-8
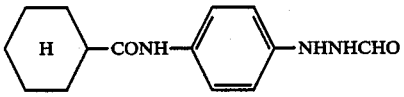
I-9
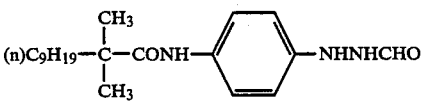
I-10
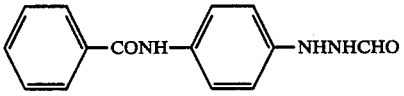
I-11
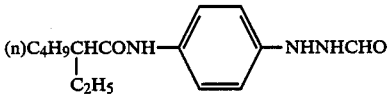
I-12
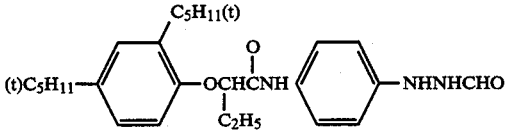
I-13
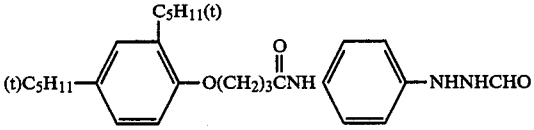

-continued
I-14
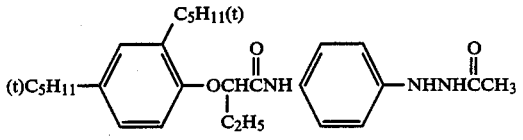
I-15
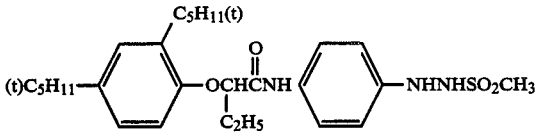
I-16
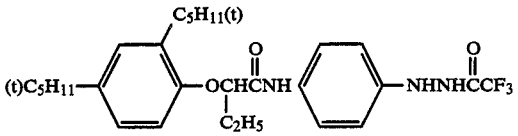
I-17
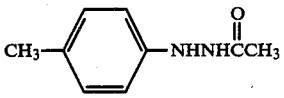
I-18
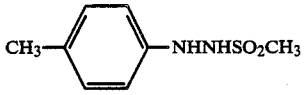
I-19
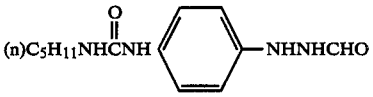
I-20
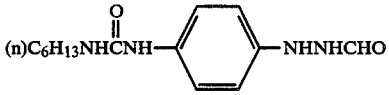
I-21
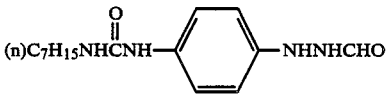
I-22
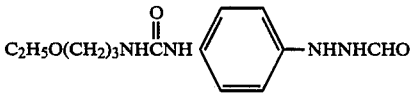
I-23
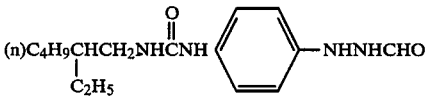
I-24
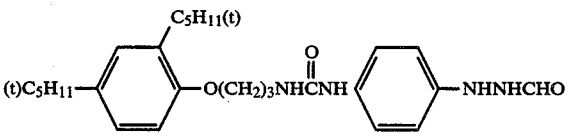
I-25
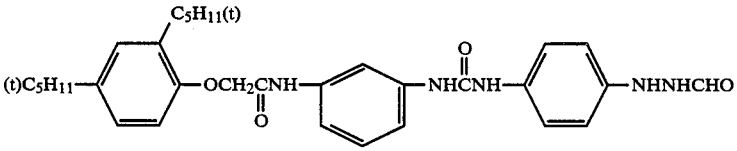

-continued

I-26

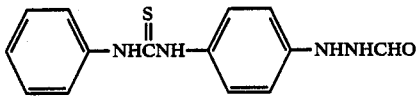

I-27

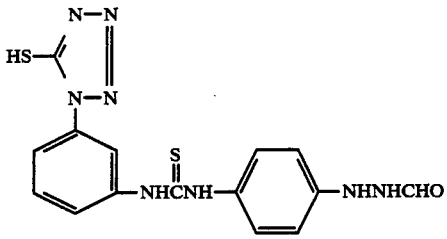

I-28

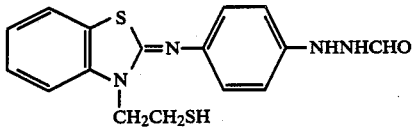

I-29

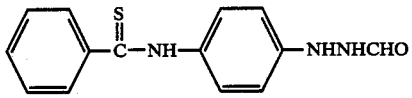

I-30

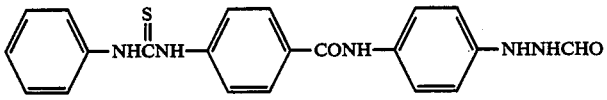

I-31

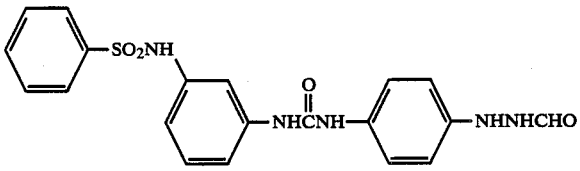

The compounds represented by the general formula (II) will hereinafter be explained in detail.

In the general formula (II), the substituent having at least one group selected from the group consisting of a hydroxy group, a group —$SO_3M^1$, a group —$COOM^1$, a substituted or unsubstituted amino group, and a substituted or unsubstituted ammonium group has about 1 to 20 carbon atoms. Preferred examples of the substituent are a substituted or unsubstituted alkylthio group, a substituted or unsubstituted alkylamino group, a substituted or unsubstituted alkylcarbamoyl group, a substituted or unsubstituted alkylsulfonamido group, and a substituted or unsubstituted alkylsulfamoyl group.

The alkyl group represented by $Z_0$ is preferably an alkyl group having about 1 to 30 carbon atoms. Particularly preferred is a straight, branched or cyclic alkyl group having about 2 to 20 carbon atoms. The alkyl group may have, as well as the above substituents, other substituents such as an alkoxy group, an aryloxy group, a hydrogen atom, a nitro group, a carbonyl group, a sulfonyl group, a sulfenyl group, an alkoxycarbonyl group or an aryloxycarbonyl group.

The aromatic group represented by $Z_0$ is preferably a monocyclic or condensed ring containing group having about 6 to 32 carbon atoms and may have, as well as the above substituents, other substituents such as an alkoxy group, an aryloxy group, a hydrogen atom, a nitro group, a carbonyl group, a sulfonyl group, a sulfenyl group, an alkoxycarbonyl group or an aryloxycarbonyl group.

The heteroaromatic group represented by $Z_0$ is preferably a monocyclic or condensed ring containing group having about 1 to 32 carbon atoms and contains a 5- or 6-membered aromatic ring containing 1 to 6 hetero atoms selected independently from nitrogen, oxygen and sulfur in one ring. The heteroaromatic group may have, as well as the above substituents, other substituents such as an alkoxy group, an aryloxy group, a hydrogen atom, a nitro group, a carbonyl group, a sulfonyl group, a sulfenyl group, an alkoxycarbonyl group or an aryloxycarbonyl group.

The ammonium group preferably has about 1 to 20 carbon atoms. The substituents include a substituted or unsubstituted, straight, branched or cyclic alkyl group (e.g., a methyl group, an ethyl group, a benzyl group, an ethoxypropyl group, and a cyclohexyl group), a substituted or unsubstituted phenyl group, and a naphthyl group.

Of the compounds represented by the general formula (II), compounds represented by the general formulae (III) and (IV) are preferred.

General Formula (III)

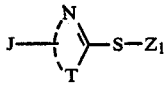

(III)

wherein:

T is an atomic group necessary for forming a 5-membered hetero ring;

J is a hydroxy group, a group $—SO_3M^1$, a group $—COOM^1$ (wherein $M^1$ has the same definition as $M^1$ in the general formula (II)), a substituted or unsubstituted amino group, a substituted or unsubstituted ammonium group, an alkylthio group having about 1 to 19 carbon atoms, an alkylamido group having about 2 to 18 carbon atoms, an alkylcarbamoyl group having about 2 to 18 carbon atoms, an alkyl group having about 1 to 19 carbon atoms, or an aromatic group having about 6 to 31 carbon atoms. The alkylthio group, the alkylamido group, alkylcarbamoyl group or alkyl group each is substituted with one or more of the above groups (i.e., a hydroxy group, a group $—SO_3M^1$, a group $—COOM^1$, a substituted or unsubstituted amino group, or a substituted or unsubstituted ammonium group); and $Z_1$ has the same definition as $Z_1$ in the general formula (II).

General Formula (IV)

$$A—ALK—SM^2 \quad (IV)$$

wherein:

A is a hydroxy group, a group $—SO_3M^1$, a group $—COOM^1$ (wherein $M^1$ has the same definition as $M^1$ in the general formula (II)), or a group $—N(R_3)_2$ (wherein $R_3$ is a substituted or unsubstituted alkyl group having 1 to 5 carbon atoms, and the two $R^3$ groups may combine together to form a ring);

ALK is a substituted or unsubstituted alkylene group having 2 to 12 carbon atoms; and $M^2$ is a hydrogen atom,

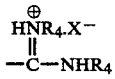

(wherein $R_4$ is a hydrogen atom, a substituted or unsubstituted alkyl group having about 1 to 5 carbon atoms, or a substituted or unsubstituted phenyl group having about 1 to 10 carbon atoms, and $X^-$ is a halide ion or a sulfonic acid ion, or a group —S—ALK—A wherein A has the same definition as above.

Of the compounds represented by the general formulae (III) and (IV), compounds represented by the general formulae (V) to (VII) are more preferred:

General Formula (V)

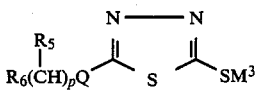

(V)

wherein:

$M^3$ is a hydrogen atom, an alkali metal atom, or a substituted or unsubstituted ammonium ion;

$R_5$ is a hydrogen atom, or a substituted or unsubstituted alkyl group having about 1 to 19 carbon atoms;

$R_6$ is a group $—SO_3M^1$, a group $—COOM^1$ (wherein $M^1$ has the same definition as in the general formula (II)), or —OH;

Q is S, NH, or CONH (linked to the thiadiazole ring through N); and p is an integer of 1 to 6.

General Formula (VI)

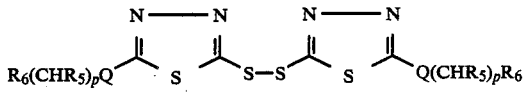

(VI)

wherein $R_5$, $R_6$, Q and p each has the same definition as in the general formula (V).

General Formula (VII)

$$A_1—(CH_2)_qSM^2 \quad (VII)$$

wherein:

$A_1$ is a hydroxy group, a group $—SO_3M^1$ (wherein $M^1$ has the same definition as in the general formula (II)), or a group $—N(R_7)_2$ (wherein $R_7$ is a substituted or unsubstituted alkyl group having about 1 to 5 carbon atoms);

$M^2$ is a hydrogen atom, a group

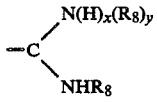

(wherein $R_8$ is a hydrogen atom, a substituted or unsubstituted alkyl group having about 1 to 5 carbon atoms, or a phenyl group, and when x and y, each is 1, the group is

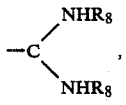

when x is 0 and y is 1, the group is

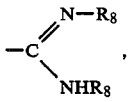

and when x is 1 and y is 0, the group is

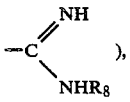

or its hydrohalogenic acid salt, arylsulfonic acid salt, or alkylsulfonic acid salt; and q is an integer of 2 to 5.

The synthetic method of the compounds of the general formula (I) is described in U.S. Pat. Nos. 4,168,977, 4,224,401, 4,171,977, and 4,323,643, and in S. R. Sandler and W. Karo, *Organic Functional Group Preparations,* Second Edition, The Academic Press, Vol. I, pages 435–465 (1983).

Preferred examples of the compounds represented by the general formula (II) are shown below, although the present invention is not to be construed as being limited thereto.

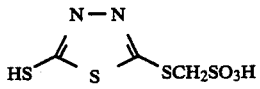

II-(1)

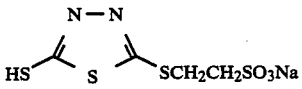

II-(2)

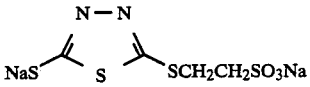

II-(3)

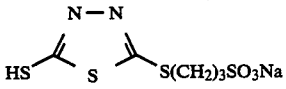

II-(4)

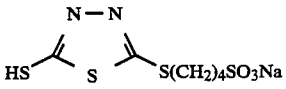

II-(5)

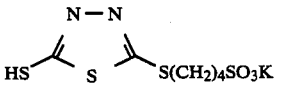

II-(6)

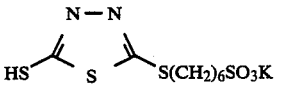

II-(7)

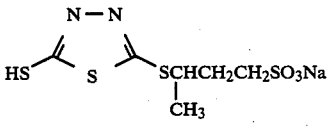

II-(8)

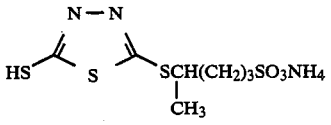

II-(9)

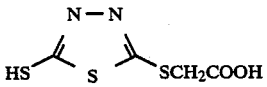

II-(10)

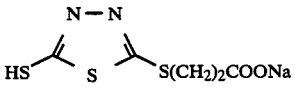

II-(11)

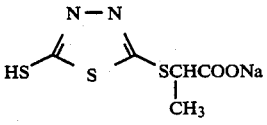

II-(12)

-continued

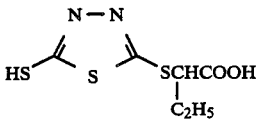

II-(13)

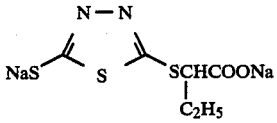

II-(14)

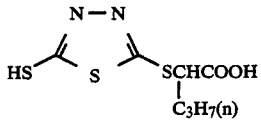

II-(15)

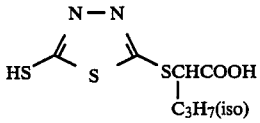

II-(16)

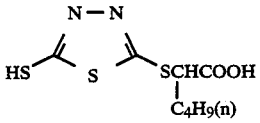

II-(17)

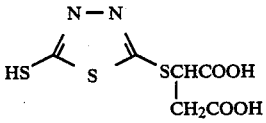

II-(18)

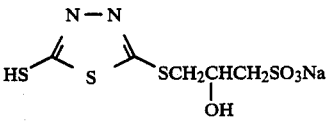

II-(19)

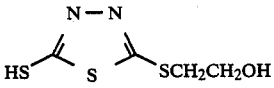

II-(20)

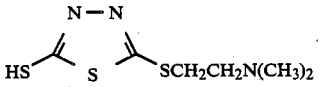

II-(21)

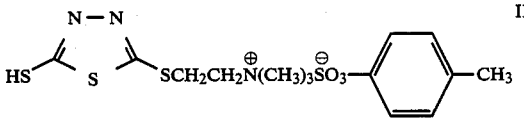

II-(22)

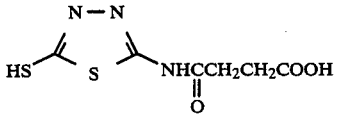

II-(23)

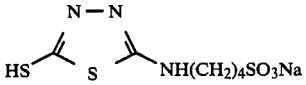

II-(24)

-continued

II-(25)

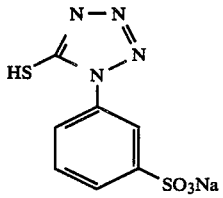

II-(26)

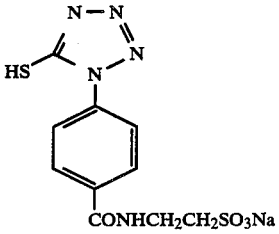

II-(27)

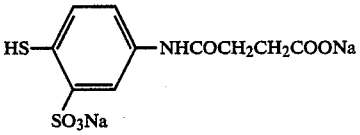

II-(28)

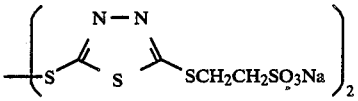

II-(29)

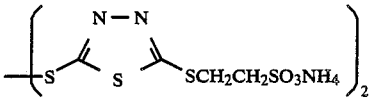

II-(30)

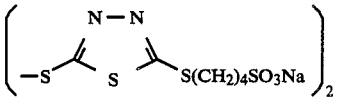

II-(31)

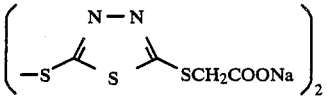

II-(32)

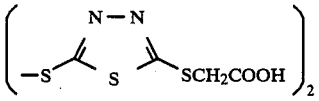

II-(33)

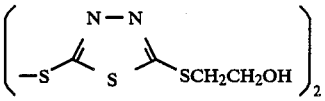

II-(34)

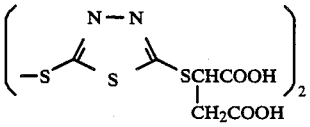

II-(35)

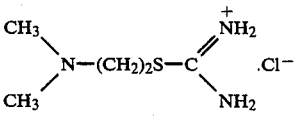

-continued

II-(36)

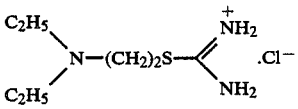

II-(37)

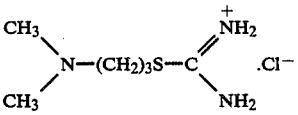

II-(38)

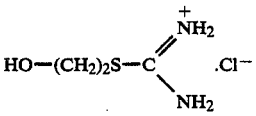

II-(39)

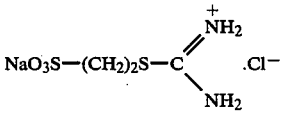

II-(40)

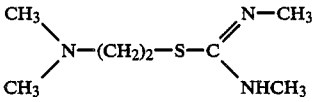

II-(41)

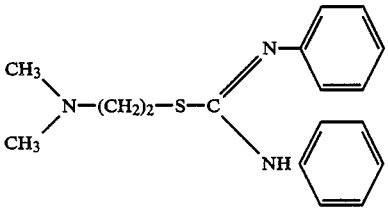

II-(42)

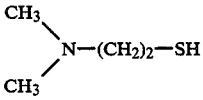

II-(43)

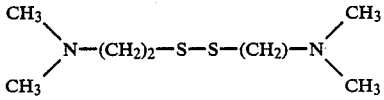

II-(44)

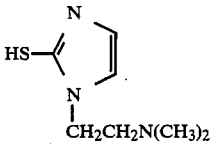

II-(45)

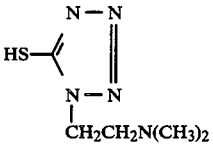

The amount of the compound of the general formula (I) used is preferably about $1\times10^{-6}$ to $5\times10^{-2}$ mol, more preferably about $1\times10^{-5}$ to $2\times10^{-2}$ mol per mol of silver halide.

The amount of the compound of the general formula (II) used is preferably about $1\times10^{-5}$ to $1\times10^{-2}$ mol, more preferably about $1\times10^{-4}$ to $1\times10^{-3}$ mol per mol of silver halide.

In incorporating the compounds of the general formulae (I) and (II), when the compounds are soluble in water, they are added as an aqueous solution to a silver halide emulsion solution or hydrophilic colloid solution, or when the compounds are insoluble in water, they are dissolved in an organic solvent compatible with water, such as alcohols (e.g., methanol and ethanol), esters (e.g., ethyl acetate), and ketones (e.g., acetone), and added as a solution of such organic solvents to a silver halide emulsion solution or hydrophilic colloid solution.

When the compound is added to a silver halide emulsion solution, it can be added at any desired stage from the start of chemical ripening to coating. Preferably the compound is added after the completion of the chemical ripening. It is particularly preferred that the compound be added to a coating solution prepared for coating.

There are no special limitations to the halogen composition of a silver halide emulsion to be used in the present invention, and any halogen composition can be employed as long as a high image contrast and a high blackened density can be obtained. For example, silver chloride, silver bromide, silver chlorobromide, silver iodobromide, silver iodochloride, and silver iodochlorobromide can be used.

Silver halide emulsions especially preferably used in the present invention are silver iodobromide, silver iodochloride, and silver iodochlorobromide emulsions containing at least about 0.5 mol% of silver iodide, and preferably about 1 to 10 mol% of silver iodide.

The silver halide emulsion as used herein can be prepared by techniques such as methods as described in P. Glafkides, *Chimie et Physique Photographique* (Paul Montel Co, 1967), G. F. Duffin, *Photographic Emulsion Chemistry* (The Focal Press Co., 1966), and V. L. Zelikman et al., *Making and Coating Photographic Emulsion* (The Focal Press Co., 1964), the conversion process described, for example, in U.S. Pat. Nos. 2,592,250 and 4,075,020, and the core/shell emulsion-preparation method described, for example, in British Pat. No. 1,027,146.

A water-soluble silver salt (aqueous silver nitrate solution) and a water-soluble halogen salt can be reacted by any of the single jet method, the double jet method, and a combination thereof. As one embodiment of the double jet method, a method in which the pAg in a liquid phase where silver halide is formed is kept constant, i.e., the "controlled double jet" method can be employed.

Silver halide particles can be formed using silver halide solvents such as ammonia, thioether, and tetra-substituted thiourea.

In accordance with the double jet method and the silver halide particle-formation method using silver halide solvents, a silver halide emulsion in which the crystal form is regular and the particle size distribution is narrow can be easily prepared.

Although silver halide particles contained in the photographic emulsion that is used in the present invention may have a relatively broad particle size distribution, it is preferred for the emulsion to have a narrow particle size distribution. It is particularly preferred that the average particle size of particles of 90% based on the total number or weight of silver halide particles be within the range of the average particle size ±40%. In general, such emulsions are called "single-dispersion emulsions".

It is preferred for the silver halide particles to be finely divided (for example, to have a particle size of not more than about 0.7 μm). It is particularly preferred that the particle size be from about 0.1 to 0.4 μm.

Silver halide particles in the photographic emulsion may have a regular crystal form, for example, cubic crystal and octahedral crystal, or an irregular crystal form, for example, spherical crystal and tubular crystal, or their composite crystal forms.

Silver halide particles may be composed of an inner portion and a surface layer which are uniform in phase, or are different in phase from each other.

Two or more silver halide emulsions prepared separately may be used in combination with each other.

In the process of formation of silver halide particles or physical ripening thereof, cadmium salts, sulfites, lead salts, thallium salts, iridium salts or complex salts thereof, rhodium salts or complex salts thereof, and so forth may be added to the silver halide emulsion used in the present invention.

The silver halide emulsion that is used in the present invention may be chemically sensitized. For this chemical sensitization, known techniques such as the sulfur sensitization method, the reduction sensitization method, and the noble metal sensitization method using gold, for example, can be employed alone or in combination with each other.

A typical example of the noble metal sensitization method is a gold sensitization method in which gold compounds, mainly gold complex salts are used. Complex salts of noble metals other than gold, such as platinum, palladium and iridium, may be used. Representative examples are described, for example, in U.S. Pat. No. 2,448,060 and British Pat. No. 618,061.

As sulfur sensitizing agents, as well as sulfur compounds contained in gelatin, various sulfur compounds such as thiosulfuric acid salts, thioureas, thiazoles, and rhodanines can be used. Representative examples are described in U.S. Pat. Nos. 1,574,944, 2,278,947, 2,410,689, 2,728,668, 3,501,313 and 3,656,955.

As reduction sensitizing agents, stannous salts, amines, formamidinesulfinic acid, silane compounds, and the like can be used. Representative examples are described in U.S. Pat. Nos. 2,487,850, 2,518,698, 2,983,609, 2,983,610 and 2,694,637.

The silver halide emulsion can be optically sensitized for the purposes of increasing its sensitivity and imparting light-sensitivity within the desired wavelength region. For this optical sensitization, spectral sensitization and supersensitization are applied using, alone or in combination, sensitizing dyes such as cyanine dyes and merocyanine dyes.

These techniques are described, for example, in U.S. Pat. Nos. 2,688,545, 2,912,329, 3,397,060, 3,615,635, 3,628,964, Japanese Patent Publication Nos. 4936/68, 14030/69, and U.S. Pat. No. 4,243,739.

Various compounds can be incorporated in the photographic emulsion as used herein for the purpose of preventing fog during the process of preparation, storage or photographic processing of the light-sensitive material, or of stabilizing its photographic characteristics, including known antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyridines; mercaptotriazines; thioketo compounds (e.g., oxadolinethione); azaindenes (e.g., triazaindenes, tetraazaindenes (particularly 4-hydroxy-substituted (1,3,3a,7)-tetraazaindenes), and pentaazaindenes); benzenethiosulfonic acid; benzenesulfinic acid; and benzenesulfonic acid amide.

Of these compounds benzotriazoles (e.g., 5-methylbenzotriazole) and nitroindazoles (e.g., 5-nitroindazole) are particularly preferred. These compounds may be incorporated in the processing solution as well as in the photographic emulsion.

In the photographic light-sensitive material of the present invention, inorganic or organic hardening agents may be incorporated in the photographic emulsion layer and other hydrophilic colloid layers. For example, chromium salts (chromium alum and chromium acetate), aldehydes (e.g., formaldehyde, glyoxal, and glutaraldehyde), N-methylol compounds (e.g., dimethylolurea and methyloldimethyl hydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g., 2,4-dichloro-6-hydroxy-s-triazine), and mucohalogenic acids (e.g., muchloric acid and mucophenoxychloric acid) can be used alone or in combination with each other.

Various surface active agents may be incorporated in the photographic emulsion layer and other hydrophilic colloid layers of the light-sensitive material of the present invention as coating aids or for various purposes, for example, for preventing static electrification, improving sliding properties, accelerating emulsification and dispersion, preventing adhesion, or improving photographic characteristics (e.g., acceleration of development, increasing contrast, and sensitization).

Examples include nonionic surface active agents such as saponin (steroids), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamine or amides, and silicone/polyethylene oxide adducts), glycidol derivatives (particularly alkenylsuccinic acid polyglyceride, and alkylphenol polyglyceride), fatty acid esters of polyhydric alcohols, and alkylesters of saccharose); anionic surface active agents containing an acidic group (e.g., a carboxyl group, a sulfo group, a phospho group, a sulfate group, and a phosphate group), such as alkylcarboxylic acid salts, alkylsulfonic acid salts, alkylbenzensulfonic acid salts, alkylnaphthalenesulfonic acid salts, alkylsulfuric acid esters, alkylphosphoric acid esters, N-acyl-N-alkyltaurins, sulfosuccinic acid esters, sulfoalkylpolyoxyethylene alkylphenyl ethers, and polyoxyethylenealkylphosphoric acid esters; amphoteric surface active agents such as amino acids, aminoalkylsulfonic acids, aminoalkylsulfuric acid or phosphoric acid esters, alkylbetaines, and aminoxides; and cationic surface active agents such as alkylamine salts, aliphatic or aromatic quaternary ammonium salts, heterocyclic quaternary ammonium salts (e.g., pyridinium and imidazolium), and aliphatic or heterocyclic ring-containing phosphonium or sulfonium salts.

Surface active agents particularly preferably used in the present invention are polyalkylene oxides having a molecular weight of at least 600 as described in U.S. Pat. No. 4,221,857.

The photographic light-sensitive material of the present invention can contain in its photographic emulsion layer or other hydrophilic colloid layers dispersions of water-insoluble or sparingly water-soluble synthetic polymers for the purpose of, e.g., improving its dimensional stability. Such synthetic polymers include homo- and copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, and styrene; and copolymers of the above monomers and monomers such as acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid.

In the photographic processing of the silver halide photographic material of the present invention, it is not necessary to use conventionally employed developers such as a hydroquinone developer (lith-developer) in which the effective concentration of sulfite ions is very low, or a high alkali developer having a pH of about 13 as described in U.S. Pat. No. 2,419,975. By treating the light-sensitive material with a developer as described hereinafter, a super-high contrast negative image can be obtained.

In the developer that is used in the present invention, it is desirable that dihydroxybenzene-based developing agents be used as the developing agents in an amount of from about 0.05 to 0.5 mol/l, and p-aminophenol- or 1-phenyl-3-pyrazolidone-based developing agents be used as auxiliary developing agents in an amount not exceeding about 0.06 mol/l.

To maintain the storage stability of the developer, sulfite preservatives, such as sodium sulfite, potassium sulfite, lithium sulfite, sodium hydrogensulfite, potassium metahydrogensulfite, and sodium formaldehydehydrogensulfite are used in an amount of at least about 0.15 mol/l, and more preferably used in an amount of about 0.4 to 2.5 mol/l.

A developer having a pH of at least about 9.5, especially about 10.5 to 12.3 is used in the present invention. It is unnecessary to use a high alkali developer having a pH of about 13 as described in U.S. Pat. No. 2,419,975. As alkali agents to adjust the pH value, commonly used water-soluble inorganic alkali metal salts (e.g., sodium hydroxide, potassium hydroxide, sodium carbonate, and potassium triphosphate) are used. These compounds are described in U.S. Pat. No. 4,269,929. In addition, alkanolamines and the like can be used to adjust the pH to a desired value.

In accordance with the present invention, photographic characteristics of ultra-high contrast ($\gamma$ of more than about 10) negative gradation can be obtained by using a stable developer as described above and by rapid development (rabid-access processing) in which the developing time is from 15 to 60 seconds. In the present invention, the processing temperature is usually chosen within the range of 18° to 50° C. and preferably, the range of 20° to 40° C.

A fixer having a commonly used composition can be used in processing the photographic material in the present invention. As fixing agents, as well as thiosulfuric acid salts and thiocyanic acid salts, organic sulfur compounds which are known effective fixing agents can be used. The fixer may contain a water-soluble aluminum salt, for example, as the hardening agent.

In the photographic processing of the light-sensitive material of the present invention, it is preferred to use an automatic developing machine. In this case, even if the total processing time for the steps of development, fixing, rinsing, and drying is as short as 90 to 120 seconds, photographic characteristics of sufficiently super-high contrast negative gradation can be obtained.

Even if dot images or line and figure images formed by processing the light-sensitive material of the present invention with the above-described processing solution are reduced with a reducing solution containing a cerium (IV) salt as a major component, no residue is formed and satisfactory reduction can be attained. The above-reduction method is described in R. F. Reed, Editor, *Dot Etching on Dry Plates and Fil,* Lithographic Technical Foundation, 1937.

The reducing solution containing the cerium (IV) salt as a major component contains a cerium (IV) salt compound in an amount of about 10 to 130 g per liter of the reducing solution. Cerium (IV) salt compounds include cerium (IV) sulfate, cerium (IV) acetate, cerium (IV) nitrate, ammonium cerium (IV) nitrate ($(NH_4)_2Ce(NO_3)_6$), potassium cerium (IV) nitrate ($K_2Ce(NO_3)_6$), cerium (IV) nitrate, and potassium. Usually cerium (IV) sulfate is used. It is preferred that concentrated sulfuric acid be added to the reducing solution in an amount of about 10 to 100 g per liter of the reducing solution.

The present invention is described in greater detail with reference to the following examples, although the present invention is not to be construed as being limited thereto. Unless otherwise indicated, all parts, percents and ratios are by weight.

EXAMPLE 1

An aqueous silver nitrate solution and aqueous solutions of potassium bromide and potassium iodide were mixed by the double jet method in the presence of tetramethylthiourea to prepare a monodispersion cubic silver iodobromide emulsion A (silver iodide content: 2 mol%; silver bromide content: 98 mol%) having an average particle size of 0.3 μm. After the formation of silver iodobromide particles, de-salting was conducted and then sulfur sensiitization was applied. This emulsion was spectrally sensitized by adding a sensitizing agent, 5,5'-dichloro-3,3'-di(3-sulfopropyl)-9-ethyl-oxacarbocyanine sodium salt, in an amount of $6\times10^{-4}$ mol per mol of silver.

In addition, as a stabilizer, 4-hydroxy-6-methyl-1,3,3a,7-tetrazaindene was added. This emulsion was equivalently divided to prepare samples. Compounds of the general formulae (I) and (II) were added as shown in Table 1. In addition, an alkylbenzensulfonic acid salt as a surface active agent and a vinylsulfonic acid-based hardening agent as a hardening agent were added, and then the emulsion was adjusted so that the concentration of gelatin was 3% and the concentration of silver iodobromide was 9%.

The pH of the emulsion was adjusted to 6.0.

Each emulsion as prepared above was coated on a polyethylene terephthalate support in such a manner that the amount of silver coated was 3.5 g/m$^2$, and a gelatin layer as a protective layer was coated on the emulsion layer in such a manner that the amount of gelatin coated was 1 g/m$^2$. In this manner, Samples (1) to (24) as shown in Table 1 were prepared.

The one sample was exposed to light through an optical wedge for sensitometry by the use of a 3,200° K. tungsten lamp. Then it was developed with a developer having a composition as shown below at 38° C. for 30 seconds, fixed, rinsed, and dried. The other sample was brought into close contact with a 150-line gray contact screen (Gray Scanner Negative No. 2 Contact Screen produced by Dai-Nippon Screen Co., Ltd.), exposed to light by the use of the same light source as above, and then subjected to the same development processing as above to form a dot image.

In this photographic processing, an automatic developing machine Model FG-660F produced by Fuji Photo Film Co., Ltd. was used.

| Developer | |
|---|---|
| Hydroquinone | 35.0 g |
| N—Methyl-p-aminophenol ½ sulfate | 0.8 g |
| Sodium hydroxide | 13.0 g |
| Potassium triphosphate | 74.0 g |
| Potassium sulfite | 90.0 g |
| Disodium ethylenediaminetetraacetate | 1.0 g |
| Potassium bromide | 4.0 g |
| 5-Methylbenzotriazole | 0.6 g |
| 3-Diethylamino-1,2-propanediol | 15.0 g |
| Water to make | 1000 ml |

The dot silver image formed by exposing through the contact screen was reduced with a reducing solution having a composition as shown hereinafter at 20° C. for 0 to 100 seconds. Then a reduction in the dot area of a dot having an area of 50% due to the reduction processing and a change in the dot density were measured. In the measurement of the dot area, a view back (produced by Nippon Regulator Co., Ltd.) was used, and the dot density was measured with a microdensitometer.

| Reducing Solution | |
|---|---|
| Concentrated sulfuric acid | 50 g |
| Cerium (IV) sulfate | 34 g |
| Water to make | 1000 ml |

The results are shown in Table 1.

The relative sensitivity is indicated as a relative value in terms of a reciprocal of an exposure amount providing a density of 1.5, and the contrast (γ) is indicated in terms of an average degree of gradation at a density of 0.3 to 3.0.

The reduction width is indicated in terms of a reduction in dot area until the dot density measured with the micro densitometer reaches 2.5.

TABLE 1

| | | Compound (I) | | Compound (II) | | | | |
|---|---|---|---|---|---|---|---|---|
| | Run No. | Type | Amount (mol/mol-Ag) | Type | Amount (mol/mol-Ag) | Relative Sensitivity | Contrast (γ) | Reduction Width |
| 1. | Comparative Example | I-12 | $3.5\times10^{-3}$ | — | — | 100 | 14.2 | 6.5% |
| 2. | " | " | $4.2\times10^{-3}$ | — | — | 120 | 15.9 | 6% |
| 3. | Invention | " | " | II-4 | $5\times10^{-4}$ | 102 | 14.2 | 13.5% |
| 4. | " | " | " | II-5 | $5\times10^{-4}$ | 107 | 15.0 | 14.0% |
| 5. | " | " | " | " | $1\times10^{-3}$ | 95 | 14.2 | 15.0% |
| 6. | " | " | $5\times10^{-3}$ | " | $1\times10^{-3}$ | 112 | 15.0 | 14.5% |
| 7. | " | " | $4.2\times10^{-3}$ | II-20 | $5\times10^{-4}$ | 102 | 14.2 | 13.5% |
| 8. | " | " | " | " | $1\times10^{-3}$ | 89 | 13.5 | 14.5% |

TABLE 1-continued

| Run No. | | Compound (I) Type | Compound (I) Amount (mol/mol-Ag) | Compound (II) Type | Compound (II) Amount (mol/mol-Ag) | Relative Sensitivity | Contrast (γ) | Reduction Width |
|---|---|---|---|---|---|---|---|---|
| 9. | " | " | " | II-24 | $5 \times 10^{-4}$ | 107 | 15.0 | 13.5% |
| 10. | " | " | " | " | $1 \times 10^{-3}$ | 93 | 14.2 | 14.0% |
| 11. | Comparative Example | " | $3.5 \times 10^{-3}$ | Comparative compound (1) | $1 \times 10^{-3}$ | 85 | 12.9 | 5.5% |
| 12. | " | I-20 | $5 \times 10^{-4}$ | — | — | 126 | 16.9 | 8% |
| 13. | Invention | " | " | II-5 | $5 \times 10^{-4}$ | 110 | 15.9 | 15.0% |
| 14. | " | " | " | " | $1 \times 10^{-3}$ | 102 | 15.0 | 16.0% |
| 15. | Invention | " | " | II-20 | $5 \times 10^{-4}$ | 105 | 15.0 | 14.5% |
| 16. | " | " | " | " | $1 \times 10^{-3}$ | 89 | 14.2 | 16.0% |
| 17. | Comparative Example | I-24 | $6 \times 10^{-4}$ | — | — | 115 | 15.9 | 7% |
| 18. | Invention | " | " | II-5 | $5 \times 10^{-4}$ | 105 | 15.0 | 14.5% |
| 19. | " | " | " | " | $1 \times 10^{-3}$ | 91 | 13.5 | 15.0% |
| 20. | " | " | " | II-24 | $5 \times 10^{-4}$ | 100 | 15.0 | 13.0% |
| 21. | " | " | " | " | $1 \times 10^{-3}$ | 85 | 14.2 | 13.5% |
| 22. | " | " | " | II-39 | $5 \times 10^{-4}$ | 105 | 13.5 | 12.0% |
| 23. | " | " | " | " | $1 \times 10^{-3}$ | 81 | 12.9 | 12.5% |
| 24. | Comparative Example | — | — | — | — | 20 | 3.5 | 3% |

Note:
*Comparative example
Comparative Compound (1)

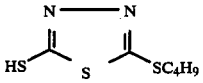

In samples (Run Nos. 3 to 10, 13 to 16, and 18 to 23) in which the compounds of the general formulae (I) and (II) were used in combination, a high contrast, i.e., a γ of more than 10 was obtained, and the reduction width was increased.

In comparative examples (Run Nos. 1, 2, 12 and 17), a yellow-brown residue remained in the reduced area, whereas in the samples of the present invention, such a residue did not remain.

EXAMPLE 2

An aqueous silver nitrate solution and aqueous solutions of potassium bromide and potassium iodide were mixed by the double jet method in the presence of ammonia while maintaining pAg at 7.5 to prepare a silver iodobromide emulsion B (silver iodide content: 3 mol%; silver bromide content: 97 mol%) having an average particle size of 0.35 μm.

A silver bromide emulsion C having an average particle size of 0.35 μm was prepared in the same manner as above except that potassium iodide was omitted.

After the formation of particles, de-salting was conducted by the coagulation precipitation method and then the emulsion was subjected to sulfur sensitization.

The emulsion A (prepared in Example 1) and the emulsions B and C were each spectrally sensitized by adding a sensitizing dye, 5,5'-dimethoxy-3,3'-di(3-sulfopropyl)-9-ethyl-oxacarbocyanine sodium salt, in an amount of $4.5 \times 10^{-4}$ mol per mol of silver.

As a stabilizer, 4-hydroxy-6-methyl-1,3,3a,7-tetrazaindene was added. In the same manner as in Example 1, the compounds of the general formulae (I) and (II) were added as shown in Table 2. In addition, an alkylbenzenesulfonic acid salt as a surface active agent and a vinylsulfonic acid based hardening agent as a hardening agent were added, and the emulsion was adjusted so that the concentration of gelatin was 4.5% and the concentration of silver iodobromide was 10.5%.

The pH of the emulsion was adjusted to 5.7.

Each emulsion as prepared above was coated on a polyethylene terephthalate support in such a manner that the amount of silver coated was 4.0 g/m$^2$, and a gelatin layer as a protective layer was coated on the emulsion layer in such a manner that the amount of gelatin coated was 1 g/m$^2$. In this manner, Samples (26) to (35) as shown in Table 2 were prepared.

The one sample was exposed to light through an optical wedge for sensitometry by the use of a 3,200° K. tungsten lamp and then processed in the same manner as in Example 1. The other sample was brought into close contact with the film (50% dot image) formed using Sample 3 of Example 1, exposed to light, and then processed in the same manner as above to prepare a 50% dot image.

In this processing, an automatic developing machine Model FG-660F produced by Fuji Photo Film Co., Ltd. was used.

The 50% reversal dot silver image was reduced and measured in the same manner as in Example 1.

The results are shown in Table 2.

TABLE 2

| Run No. | | Emulsion | Compound (I) Type | Compound (I) Amount (mol/mol-Ag) | Compound (II) Type | Compound (II) Amount (mol/mol-Ag) | Relative Sensitivity | Contrast (γ) | Reduction Width |
|---|---|---|---|---|---|---|---|---|---|
| 26. | Comparative Example | A (AgBrI) I = 2 mole % | I-12 | $4.2 \times 10^{-3}$ | | — | 100 | 18 | 4.0% |
| 27. | Invention | " | " | " | II-5 | $5 \times 10^{-4}$ | 87 | 16.9 | 9.5% |
| 28. | " | " | " | " | " | $1 \times 10^{-3}$ | 79 | 15.9 | 10.0% |
| 29. | " | " | " | " | II-33 | $5 \times 10^{-4}$ | 81 | 15.0 | 8.0% |
| 30. | Comparative | B (AgBrI) | " | " | | — | 132 | 15.9 | 3.0% |

TABLE 2-continued

| Run No. | Emulsion | Compound (I) Type | Compound (I) Amount (mol/mol-Ag) | Compound (II) Type | Compound (II) Amount (mol/mol-Ag) | Relative Sensitivity | Contrast (γ) | Reduction Width |
|---|---|---|---|---|---|---|---|---|
| Example | I = 3 mole % | | | | | | | |
| 31. Invention | " | " | " | II-5 | $5 \times 10^{-4}$ | 117 | 15.0 | 8.0% |
| 32. " | " | " | " | " | $1 \times 10^{-3}$ | 110 | 14.2 | 9.0% |
| 33. " | " | " | " | II-33 | $5 \times 10^{-4}$ | 100 | 13.5 | 7.5% |
| 34. Comparative Example | C (AgBr) | " | " | | — | 110 | 11.2 | 7.0% |
| 35. Invention | " | " | " | II-5 | $5 \times 10^{-4}$ | 95 | 10.8 | 9.0% |
| 36. " | " | " | " | " | $1 \times 10^{-3}$ | 87 | 10.0 | 8.5% |
| 37. " | " | " | " | II-33 | $5 \times 10^{-4}$ | 79 | 9.6 | 8.0% |

In samples (Run Nos. 27 to 29, and 31 to 33) in which the compounds of the general formulae (I) and (II) were used in combination, the reduction width was increased, and the contrast was such that γ was more than 10.

In samples (Run Nos. 35 to 37) in which the silver bromide emulsion C was used, when the compounds of the general formulae (I) and (II) were used in combination, the effect of increasing the reduction width was small.

While the invention has been described in detail and with reference to specific embodiments thereof, it will be apparent to one skilled in the art that various changes and modifications can be made therein without departing from the spirit and scope thereof.

What is claimed is:

1. A negative-type silver halide photographic material comprising a support having thereon at least one light-sensitive silver halide emulsion layer, said silver halide emulsion layer or a hydrophilic colloid layer adjacent thereto containing (a) a compound represented by the following general formula (I):

$$R_1—NHNH—G—R_2 \quad (I)$$

wherein $R_1$ is an aliphatic or aromatic group, $R_2$ is a hydrogen atom, a substituted or unsubstituted alkyl group, a substituted or unsubstituted aryl group, a substituted or unsubstituted alkoxy group, or a substituted or unsubstituted aryloxy group, and G is a carbonyl group, a sulfonyl group a sulfoxy group, a phosphoryl group, or an N-substituted or unsubstituted imino group, and (b) a compound represented by the following general formulae (III) or (IV)

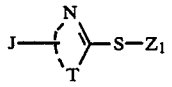

(III)

wherein T is an atomic group necessary for forming a 5-membered hetero ring composed of 3 or 4 hetero atoms selected from nitrogen, oxygen and sulfur; J is a hydroxy group, a $—SO_3M^1$ group, a $—COOM^1$ group, an alkylthio group having about 1 to 19 carbon atoms which is substituted with a hydroxy group, a $—SO_3M^1$ group, a $—COOM^1$ group, a substituted amino or a substituted ammonium group, an alkylamido group having about 2 to 18 carbon atoms which is substituted with a hydroxy group, a $—SO_3M^1$ group, a $—COOM^1$ group, a substituted amino or a substituted ammonium group, an alkylcarbamoyl group having about 2 to 18 carbon atoms which is substituted with a hydroxy group, a $—SO_3M^1$ group, a $—COOM^1$ group, a substituted amino or a substituted ammonium group, an alkyl group having about 1 to 19 carbon atoms which is substituted with a hydroxy group, a $—SO_3M^1$ group, a $—COOM^1$ group, a substituted amino or a substituted ammonium group, or an aromatic group having about 6 to 31 carbon atoms which is substituted with a hydroxy group, a $—SO_3M^1$ group, a $—COOM^1$ group, a substituted amino or a substituted ammonium group, wherein $M^1$ is a hydrogen atom, an alkali metal atom, or a substituted or unsubstituted ammonium ion; and $Z_1$ is a hydrogen atom, an alkali metal atom, a substituted or unsubstituted amidino group, a hydrohalogenic acid salt or a sulfonic acid salt thereof, or $—S—Z_O$ wherein $Z_O$ is an alkyl group, an aromatic group, or a heteroaromatic group, said group $Z_O$ being substituted with at least one group selected from the group consisting of a hydroxy group, a $—SO_3M^1$ group, or a $—COOM^1$ group wherein $M^1$ is a hydrogen atom, an alkali metal atom, or a substituted or unsubstituted ammonium ion, a substituted or unsubstituted amino group or a substituted or unsubstituted ammonium group, or with a substituent having at least one group selected from the above groups:

$$A—ALK—SM^2 \quad (IV)$$

wherein A is a hydroxy gorup, a $—SO_3M^1$ group, a $—COOM^1$ group or a $—N(R_3)_2$ group, where $M^1$ is as defined above, $R_3$ is a substituted or unsubstituted alkyl group having 1 to 5 carbon atoms and the two $R^3$ groups may combine to form a ring; ALK is a substituted or unsubstituted aklylene group having 2 to 12 carbon atoms; and $M^2$ is a hydrogen atom, a —S—ALK—A group or a

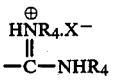

group wherein $R_4$ is a hydrogen atom, a substituted or unsubstituted alkyl group having about 1 to 5 carbon atoms or a substituted or unsubstituted phenyl group having about 1 to 10 carbon atoms, and $X^-$ is a halide ion or a sulfonic acid ion.

2. The negative-type silver halide photographic material as claimed in claim 1, wherein the light-sensitive silver halide emulsion layer is composed of a silver halide emulsion containing at least about 0.5 mol% of silver iodide.

3. The negative-type silver halide photographic material as claimed in claim 1, wherein said aliphatic group represented by $R_1$ is a straight, branched or cyclic alkyl group having about 1 to 20 carbon atoms, said aromatic group represented by $R_1$ is a monocyclic aryl group, a dicyclic aryl group or an unsaturated heterocyclic group, said alkyl group represented by $R_2$ is an alkyl group having 1 to 4 carbon atoms, said aryl group represented by $R_2$ is a monocyclic or dicyclic aryl group, said alkoxy group represented by $R_2$ contains 1 to 8 carbon atoms and said aryloxy group represented by $R_2$ is monocyclic.

4. The negative-type silver halide photographic material as claimed in claim 3, wherein G is a carbonyl group and $R_2$ is a hydrogen atom, a methyl group, a methoxy group, an ethoxy group or a substituted or unsubstituted phenyl group.

5. The negative-type silver halide photographic material as claimed in claim 3, wherein G is a sulfonyl group, and $R_2$ is a methyl group, an ethyl group, a phenyl group or a 4-methylphenyl group.

6. The negative-type silver halide photographic material as claimed in claim 3, wherein G is a phosphoryl group, and $R_2$ is methoxy group, an ethoxy group, a butoxy group, a phenoxy group or a phenyl group.

7. The negative-type silver halide photographic material as claimed in claim 3, wherein G is a sulfoxy group and $R_2$ is a cyanobenzyl group or a methylthiobenzyl group.

8. The negative-type silver halide photographic material as claimed in claim 3, wherein G is an N-substituted or unsubstituted imino group and $R_2$ is methyl group, an ethyl group or a substituted or unsubstituted phenyl group.

9. The negative-type silver halide photographic material as claimed in claim 4, wherein $R_2$ is a hydrogen atom.

10. The negative-type silver halide photographic material as claimed in claim 1, wherein said compound represented by general formula (III) is represented by the following general formula (V):

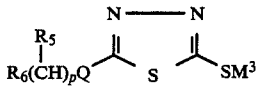

(V)

wherein:

$M^3$ is a hydrogen atom, an alkali metal atom, or a substituted or unsubstituted ammonium ion;

$R_5$ is a hydrogen atom or a substituted or unsubstituted alkyl group having about 1 to 19 carbon atoms;

$R_6$ is a group $—SO_3M^1$, a group $—COOM^1$, wherein $M^1$ has the same definition as $M^1$ in the general formula (II), or —OH;

Q is S, NH, or CONH linked to the thiadiazole ring through N; and p is an integer of 1 to 6.

11. The negative-type silver halide photographic material as claimed in claim 1, wherein said compound of general formula (I) is present in an amount of about $1\times10^{-6}$ to $5\times10^{-2}$ mol per mol of silver halide, and said compound of general formula (III) is present in an amount of from about $1\times10^{-5}$ to $1\times10^{-2}$ mol per mol of silver halide.

12. A process comprising imagewise exposing a negative-type silver halide photographic material, developing said negative-type silver halide photographic material comprising a support having thereon at least one light-sensitive silver halide emulsion layer, said silver halide emulsion layer or a hydrophilic colloid layer adjacent thereto containing (a) a compound represented by the following general formula (I):

$$R_1—NHNH—G—R_2 \quad (I)$$

wherein $R_1$ is an aliphatic or aromatic group, $R_2$ is a hydrogen atom, a substituted or unsubstituted alkyl group, a substituted or unsubstituted aryl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group, and (b) a compound represented by the following general formulae (III) or (IV)

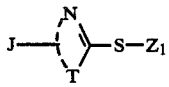

(III)

wherein T is an atomic group necessary for forming a 5-membered hetero ring composed of 3 or 4 hetero atoms selected from nitrogen, oxygen and sulfur; J is a hydroxy group, a $—SO_3M^1$ group, a $—COOM^1$ group, an alkylthio group having about 1 to 19 carbon atoms which is substituted with a hydroxy group, a $—SO_3M^1$ group, a $—COOM^1$ group, a substituted amino or ammonium group, an alkylamido group having about 2 to 18 carbon atoms which is substituted with a hydroxy group, a $—SO_3M^1$ group, a $—COOM^1$ group, a substituted amino or ammonium group, an alkylcarbamoyl group having about 2 to 18 carbon atoms which is substituted with a hydroxy group, a $—SO_3M^1$ group, a $—COOM^1$ group, a substituted amino or ammonium group, an alkyl group having about 1 to 19 carbon atoms which is substituted with a hydroxy group, a $—SO_3M^1$ group, a $—COOM^1$ group, a substituted amino or ammonium group, or an aromatic group having about 6 to 31 carbon atoms which is substituted with a hydroxy group, a $—SO_3M^1$ group, a $—COOM^1$ group, a substituted amino or ammonium group; $M^1$ is a hydrogen atom, an alkali metal atom, or a substituted or unsubstituted ammonium ion; and $Z_1$ is a hydrogen atom, an alkali metal atom, a substituted or unsubstituted amidino group, a hydrohalogenic acid salt or a sulfonic acid salt thereof, or $—S—Z_O$ wherein $Z_O$ is an alkyl group, an aromatic group, or a heteroaromatic group, said group $Z_O$ being substituted with at least one group selected from the group consisting of a hydroxy group, a $—SO_3M^1$ group, or a $—COOM^1$ group wherein $M^1$ is a hydrogen atom, an alkali metal atom, or a substituted or unsubstituted ammonium ion, a substituted or unsubstituted amino group or a substituted or unsubstituted ammonium group, or with a substituent having at least one group selected from the above groups;

$$A—ALK—SM^2 \quad (IV)$$

wherein A is a hydroxy group, a $—SO_3M^1$ group, a $—COOM^1$ group or a $—N(R_3)_2$ group, where $M^1$ is as defined above, $R_3$ is a substituted or unsubstituted alkyl group having 1 to 5 carbon atoms, and the two $R_3$ groups may combine to form a ring; ALK is a substituted or unsubstituted alkylene group having 2 to 12 carbon atoms; and $M_2$ is a hydrogen atom, a group —S—ALK—A or a group $$\begin{array}{l} \overset{\oplus}{HNR_4}.X^- \\ \| \\ -C-NHR_4 \end{array}$$

wherein $R_4$ is a hydrogen atom, a substituted or unsubstituted alkyl group having about 1 to 5 carbon atoms or a substituted or unsubstituted phenyl group having about 1 to 10 carbon atoms, and $X^-$ is a halide ion or a sulfonic acid ion.

13. The process as claimed in claim 12, wherein said compound of general formula (I) is present in an amount of about $1\times10^{-6}$ to $5\times10^{-2}$ mol per mol of silver halide, and said compound of general formula (II) is present in an amount of from about $1\times10^{-5}$ to $1\times10^{-2}$ mol per mol of silver halide.

14. The process as claimed in claim 12, wherein said reducing solution contains a cerium (IV) salt.

15. The process as claimed in claim 12, wherein in the negative-type silver halide photographic material said aliphatic group represented by $R_1$ is a straight, branched or cyclic alkyl group having about 1 to 20 carbon atoms, said aromatic group represented by $R_1$ is a monocyclic aryl group, a dicyclic aryl group or an unsaturated heterocyclic group, said alkyl group represented by $R_2$ is an alkyl group having 1 to 4 carbon atoms, said aryl group represented by $R_2$ is an a monocyclic or dicyclic aryl group, said alkoxy group represented by $R_2$ contains 1 to 8 carbon atoms and said aryloxy group represented by $R_2$ is monocyclic.

16. The process as claimed in claim 13, wherein G is a carbonyl group and $R_2$ is a hydrogen atom, a methyl group, a methoxy group, an ethoxy group or a substituted or unsubstituted phenyl group.

17. The process as claimed in claim 13, wherein G is a sulfonyl group, and $R_2$ is a methyl group, an ethyl group, a phenyl group or a 4-methylphenyl group.

18. The process as claimed in claim 13, wherein G is a phosphoryl group, and $R_2$ is methoxy group, an ethoxy group, a butoxy group, a phenoxy group or a phenyl group.

19. The process as claimed in claim 13, wherein G is a phosphoryl group, and $R_2$ is a cyanobenzyl group or a methylthiobenzyl group.

20. The process as claimed in claim 13, wherein G is an N-substituted or unsubstituted imino group and $R_2$ is a methyl group, an ethyl group or a substituted or unsubstituted phenyl group.

21. The process as claimed in claim 14, wherein $R_2$ is a hydrogen atom.

* * * * *